US006187451B1

(12) United States Patent
Boos

(10) Patent No.: US 6,187,451 B1
(45) Date of Patent: Feb. 13, 2001

(54) WELDED JOINT FOR ARMORED VEHICLES

(75) Inventor: Stephen J. E. Boos, Ottawa (CA)

(73) Assignee: Her Majesty the Queen in right of Canada, as represented by the Solicitor General acting through the Commissioner of the Royal Canadian Mounted Police, Ottawa (CA)

( * ) Notice: Under 35 U.S.C. 154(b), the term of this patent shall be extended for 0 days.

(21) Appl. No.: 09/170,972

(22) Filed: Oct. 14, 1998

(51) Int. Cl.[7] ..... F41H 5/013

(52) U.S. Cl. ..... 428/598; 428/599; 89/36.02; 89/36.08

(58) Field of Search ..... 428/594, 598, 428/599; 228/170, 189; 89/36.02, 36.08, 36.07; 109/70

(56) References Cited

U.S. PATENT DOCUMENTS

| | | | | |
|---|---|---|---|---|
| Re. 29,463 | * | 11/1977 | Bognacs et al. | 62/55 |
| 1,446,274 | * | 2/1923 | Roberts | 428/609 |
| 1,617,114 | * | 2/1927 | Hoehn | 228/189 |
| 1,700,319 | * | 1/1929 | Kjekstad | 228/189 |
| 2,679,468 | * | 5/1954 | Pitman | 428/594 |
| 3,720,995 | * | 3/1973 | Brown et al. | 428/594 |
| 3,785,696 | * | 1/1974 | Moore et al. | 296/102 |
| 4,307,911 | | 12/1981 | Pavlik . | |
| 4,316,404 | | 2/1982 | Medlin . | |
| 4,362,083 | | 12/1982 | Straub . | |
| 4,873,415 | * | 10/1989 | Johnson et al. | 219/121.64 |
| 5,284,289 | * | 2/1994 | Killian | 228/189 |
| 6,010,669 | * | 1/2000 | Miola et al. | 228/189 |

* cited by examiner

*Primary Examiner*—John J. Zimmerman
(74) *Attorney, Agent, or Firm*—Ronald G. Bitner

(57) ABSTRACT

A welded joint suitable for connecting armor plates in armored vehicles obtained by providing one of the armor plates, or an interconnecting element, with a semi-circular rounded lobe; and welding the lobe to the plate to be joined to form a U-shaped welded region such that the ends thereof are directed to the outside edge of the plate so that a crack formed in the weld will tend to propagate along the weld to the outside of the plate. The joint can be used for lap joints, angled joints, and joints involving multi-layers of plates. The joints facilitate utilizing the armor plates to provide a unitary mechanical structure for the vehicle.

4 Claims, 2 Drawing Sheets

Fig.9
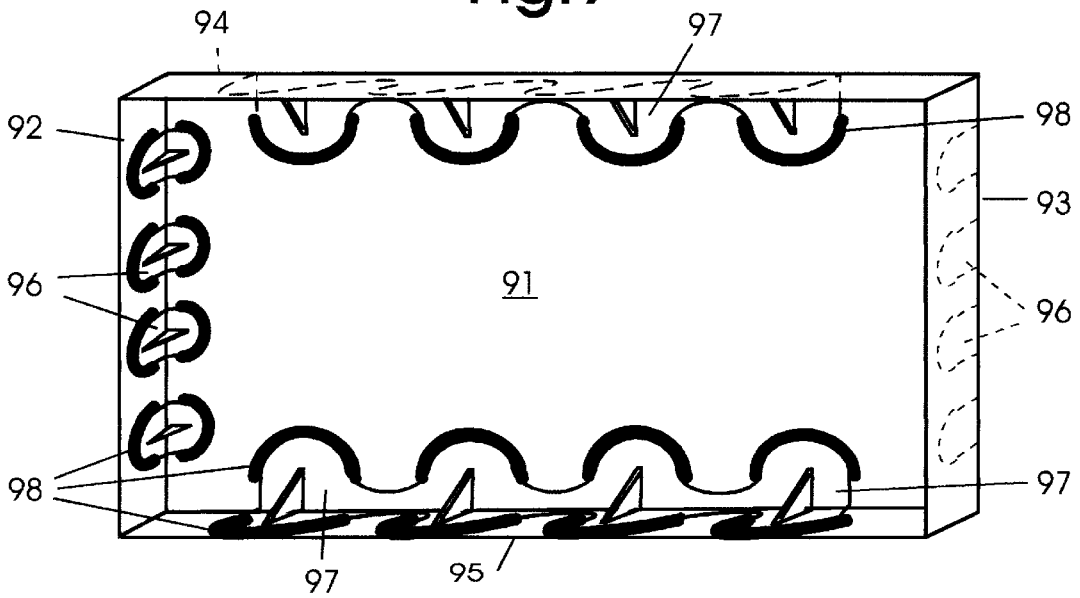
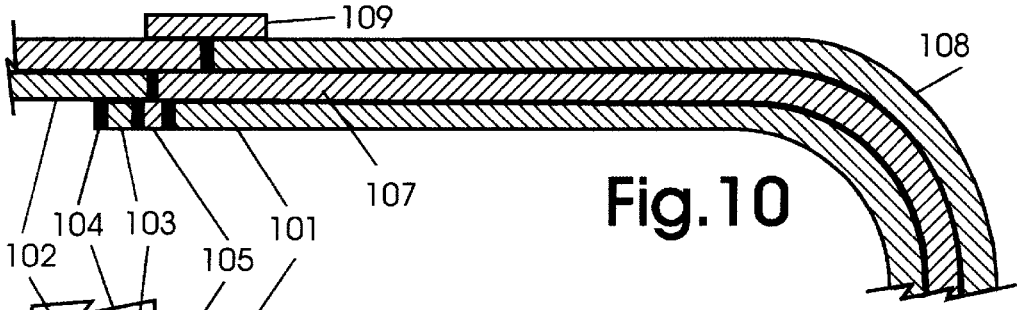
Fig.10
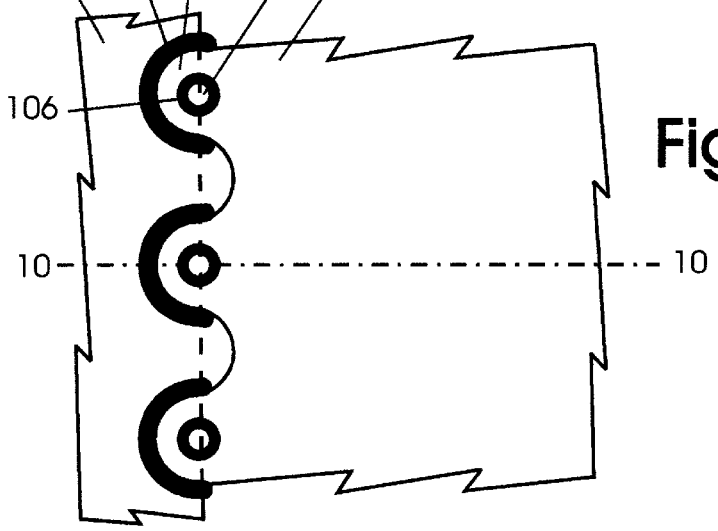
Fig.11

WELDED JOINT FOR ARMORED VEHICLES

FIELD OF THE INVENTION

This invention relates to a welded joint, and more particularly to a welded joint for armored vehicles.

BACKGROUND OF THE INVENTION

The armoring of vehicles usually requires that plates are held together and/or in place by some form of mechanical fastener or welding. Ballistic protection is enhanced either by overlapping the armor plates or by covering over joints with additional plates. In most cases the armor materials are parasitic and do not add any significant strength to the vehicle.

The high overpressures and shock waves produced by the explosives cause the plates to exert a great amount of force on the mechanical fasteners and/or welds. As a result, pieces of armor can become dislodged and become shrapnel as well. Often the armor will fail at the site of a pre-formed hole or a weld. The net effect of non-directional explosive attack on most current armor systems is to dislodge the armor and significantly alter the structure of the vehicle to the point that it is no longer continuous.

As indicated above, a particular problem associated with joined armor plates is that the failure tends to occur at the joint. Once a crack is initiated, it tends to propagate, and often results in catastrophic failure of the entire plate.

SUMMARY OF THE INVENTION

An object of the present invention to provide an improved an improved joint for armored plates that provides reduced susceptibility to failure of the plates.

A specific object of the present invention is to provide a joint configuration whereby the propagation of any crack is directed to the outside of the plate.

Another object of the invention is to allow utilizing the armor plates to provide a continuous unitary mechanical structure for the vehicle.

It has been found that an improved joint for armored plates can be obtained by providing one of the armor plates, or an interconnecting element, with a semi-circular rounded lobe; and welding the lobe to the plate to be joined near to an outside edge thereof to form a U-shaped welded region such that the ends of the welded region are directed to the outside edge of the plate so that a crack formed in the weld will tend to propagate along the weld to the outside of the plate rather than into the plate.

BRIEF DESCRIPTION OF THE DRAWINGS

FIG. 9 is a perspective view showing the welded joint structure for an armored door.

FIG. 10 is a sectional view showing the roof of an armored vehicle, with the section taken at 10—10 of FIG. 11.

FIG. 11 is a bottom view showing the welded structure on the roof of an armored vehicle as shown in FIG. 10.

DESCRIPTION OF THE PREFERRED EMBODIMENTS

Figure 1:
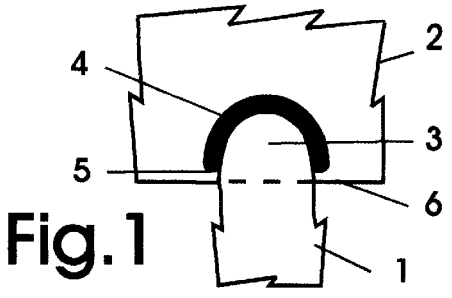
FIG. 1 is a schematic representation of one embodiment of the invention, showing a single lobe welded in a lap joint.
Figure 2:
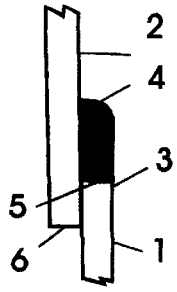
FIG. 2 is an side view of the joint of FIG. 1.

FIGS. 1 and 2 show the present invention in its simplest form, wherein two plates 1 and 2 are joined by welding. One of the plates 1 is provided with an edge configured with a rounded semi-circular lobe 3. The lobe of plate 1 is welded to plate 2 to form a U-shaped welded regions 4 in such a manner that the ends 5 of the welded regions 4 are directed to the outside edge 6 of the plate 2.

This U-shaped configuration of the welds provides that a crack formed in the weld will tend to propagate along the weld to the outside edge of the other plate 2 to which the lobes are welded. This arrangement whereby any failure follows the weld line and runs out of the plate and not into them in turn prevents catastrophic failure of the joined plate.

Figure 3:
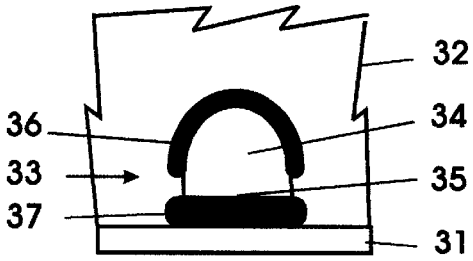
FIG. 3 is a schematic representation of another embodiment of the invention showing a lobed connecting element welded to form a corner joint.
Figure 4:
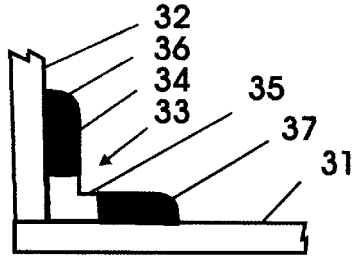
FIG. 4 is an side view of the joint of FIG. 3.

FIGS. 3 and 4 show another embodiment of the invention wherein two plates 31 and 32 are joined at right angles by means of an intermediate connecting element 33. The connecting element 33 is provided with semi-circular lobes 34 and 35 on opposite sides and bent at an angle to conform to the angle desired of the plates 31 and 32, which are shown at right angle. As in the embodiment of FIG. 1, the lobes 34 and 35 are welded in a U-shaped configuration 36 and 37, respectively. As in the embodiment of FIGS. 1 and 2, the ends of the welded regions 36 and 37 are directed to the outside edge of the respective plate so that any cracks will be directed to the outside edge of the plate, rather than inwards.

Figure 5:
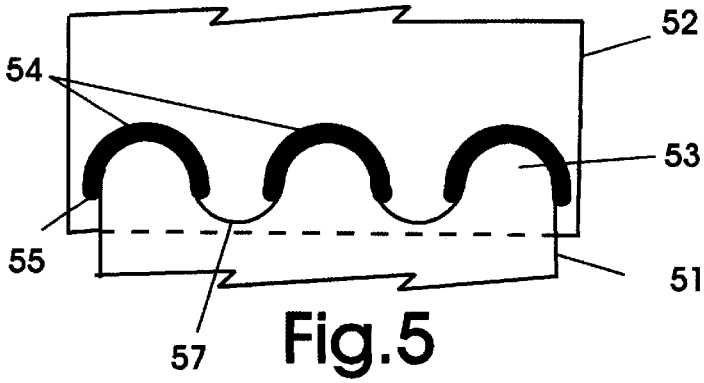
FIG. 5 is a schematic representation of another embodiment showing a lap joint with a plurality of interconnected lobes.
Figure 6:
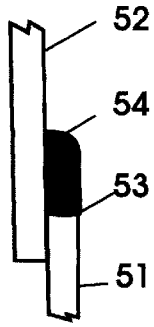
FIG. 6 is an side view of the joint of FIG. 5.

In the embodiment of FIGS. 5 and 6, one of the plates 51 to be joined has a plurality of lobes 53 interconnected to one another by an intermediate smooth curved edge portion 57 to form a sine-wave-like appearance. As in the previous embodiments the welding 54 of each lobe forms a U-shaped weld with ends that are directed to the outside of the plate.

Figure 7:
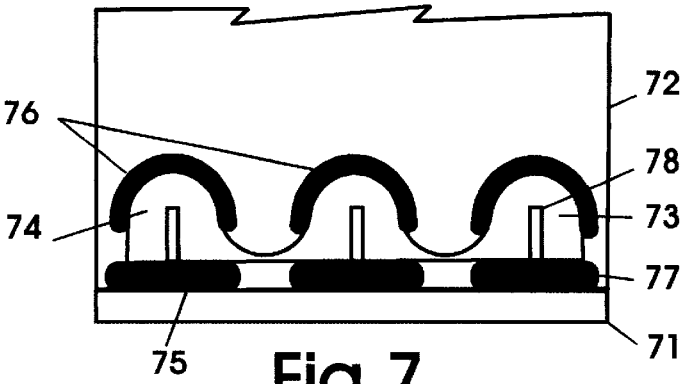
FIG. 7 is a schematic representation of another embodiment showing a corner joint with a plurality of interconnected lobes which are provided with reinforcing gussets.
Figure 8:
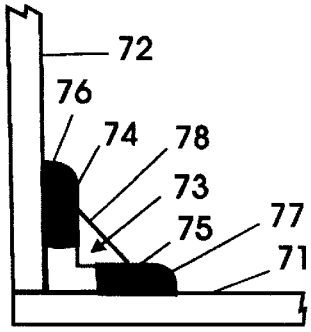
FIG. 8 is an side view of the joint of FIG. 7.

In the embodiment of FIGS. 7 and 8, two plates 71 and 72 are joined at right angles by means of an intermediate connecting element 73. The connecting element 73 is provided with a plurality of semi-circular lobes 74 and 75 on opposite sides and bent at an angle to conform to the angle desired for the plates 71 and 72, shown as right angle. As in the previous embodiments the lobes 74 and 75 are welded in a U-shaped configuration 76 and 77, respectively. As in the previous embodiments, the ends of welded regions 76 and 77 are directed to the outside edge of the plate so that any cracks will be directed to the outside edge of the plates.

FIGS. 7 and 8 show the connecting element provided with triangular gussets 78 welded to the lobed connecting element to reinforce the corner joint. For most applications it is preferable that the gusset does not extend to the extreme end of the lobe, so as to maintain some flexibility of the end of the lobe in the region of the weld. For maintaining the greatest flexibility of the welded lobe, the gusset would extend only to the base portion, or root, of the lobe.

FIG. 9 shows the use of lobed elements such as shown in FIGS. 3 and 7 incorporated into a welded structure suitable for an armored door.

Referring to FIG. 9, the door structure includes a hinge plate 92, a lock plate 93, a top belt-line bar 94, and bottom plate 95. The hinge plate 92 and lock plate 93 are shown connected to the door armor plate 91 by means of interconnecting elements 96 similar to those shown in FIGS. 3 and 4. The top and bottom plates 94 and 95 are shown connected to the door body 91 by means of interconnecting elements 97 similar to those shown in FIGS. 7 and 8. As in the previous embodiments, the ends of welded regions 98 are directed to the outside edge of the plates so that any cracks will be directed to the outside of the plate 91.

As detailed in the examples below the door structure will preferably comprise a number of layers including a hard outer layer and a softer tough layer which is connected to the hinge plate, a lock plate, a top belt-line bar, and bottom plate with the connecting means of the present invention, as described above.

The hard outer armor layer is designed to redirect or alter bullets or shrapnel while the softer tough inner layer absorbs energy and provides a tough mechanical structure. An additional inner layer of a material such as Spectra may be used to trap any fragments of the first two layers of armor that may have become dislodged or passed the first two armor layers.

FIGS. 10 and 11 show the present invention incorporated into the roof of an armored vehicle.

Referring to FIGS. 10 and 11, the welded joint of one of the layers 101 of the roof uses lobes 103 similar to that of FIG. 5. In addition, the layered structure uses circular elements 105, that are welded to form an annular welded region 106, to reinforce the lap joint of an adjacent layer 107. As in the previous embodiments, the ends of U-shaped welded regions 104 are directed to the outside edge of the plate so that any cracks will be directed to the outside of the plate 102. These U-shaped elements employ the same principle as the lobes in directing any cracks to the outside of the plate.

The armor plates used for the roof of a vehicle will preferably comprise a plurality of layers of different materials having differing hardness and modulus properties, specifically, a relatively hard outer layer 108 and a softer but tougher layer, or layers (101 and 107) as shown in FIG. 10. FIG. 10 also shows the use of a tab strip 109 covering a butt joint in the outer hard layer 108.

The combination of a hard steel backed by a softer steel provides the strength and toughness desired to withstand the impact of explosives. The use of overlapping plates and staggered weld lines and the use of the semi-circular lobes of the present invention causes the explosive energy to be redirected and reduces the likelihood of catastrophic failure of the welds.

It should be noted that in multiple layer configurations involving bard and relatively soft layers, the welded connection will preferably be made onto the softer layer which is affected less, with regard to mechanical properties, by the welding.

The construction of the door and roof as described above, effectively provides a continuous unitary mechanical structure whereby impact forces are distributed to the entire cage of the vehicle.

The present invention can be used for plates in various configuration. As illustrated above the present invention can be used for lap joints or corner joints. It will be understood that the plates can be various shapes and connected at various angles.

EXAMPLES/TESTS

Tests were conducted to determine if armor plates comprising of 3 mm of Sanderson Keyser Bulloy 500 steel, or 3 mm of Compass B555 steel, and 3 mm of Jessop 529 steel connected to a hinge plate, a lock plate, a top belt-line bar, and bottom plate by welded joints in accordance with the present invention can be used as an armour system in an automotive door to provide protection against a contact detonated steel pipe bomb filled with 454 g of smokeless powder. The arrangement was similar to that shown in FIG. 9.

The door structure comprised an outer door skin of 1 mm mild steel, an outer armor layer of 3 mm Sanderson Keyser Bulloy 500 steel, or 3 mm of Compass B555 steel, a 3 mm layer of Jessop 529 steel, a layer of 4.9 kg/m$^2$ Spectrashield™, and an inner 1 mm aluminum witness panel. For some tests the armor layers were bonded with a bonder layer of urethane or polysulphide. The outer armor layer of 3 mm Sanderson Keyser Bulloy 500 steel or Compass B555 steel has a high hardness designed to redirect or alter bullets or shrapnel while the layer of Jessop 529 steel is softer and tougher and provides a tough mechanical structure and absorbs energy. The inner Spectra layer traps any fragments of the first two layers of armor that may have become dislodged or passes the first two armor layers.

The joints between the inner armor plate and the hinge plate, lock plate, belt-line bar, and bottom plate each comprised four lobes reinforced with gussets similar to that shown in FIG. 9.

The pipe bomb was suspended against the door skin with its axis parallel to the vehicle's axis and located adjacent to the center of the lower half of the door. The door was complete with glazing.

In one test in which the gussets extended to the edge of the lobe, one of the lobes close to the site of impact pushed the inner layer of armor into the other layer so that the outer layer had a semi-circular crack. Although this crack was not considered a system failure, the gussets were shortened so as not to extend to the edge of the lobe thereby allowing the lobe to flex and avoid such damage to the other armor layer. Subsequent test proved this to be effective.

Following the tests it was observed that the outer door skin was badly damaged and pulled out at the bottom. The armor system was depressed (eg. 57 and 71 mm depression) but remained intact. There was no penetration of the inner witness panel. It was concluded that an occupant would not have been harmed by such a contact detonated steel pipe bomb filled with 454 g of smokeless powder.

A further test was conducted to determine if welded joints in the roof of an armored vehicle could withstand the force of a pipe bomb detonated in contact with the roof pan. The arrangement of armor layers and joints between the roof pan (two layers) and roof rail (3 layers) was similar to that shown in FIGS. 10 and 11.

The front and side welded joints were as follows; an outer layer of steel butt welded together; a second layer of steel butt welded and lap welded to the outer layer 12 mm from the outer layer weld; a third layer of steel overlaped both butt welds and had semi-circular lobes lap welded to the second layer of steel. The side joints are shown in FIGS. 10 and 11. A weld joint at the center of the roof was identical to the front except that the third layer was a double sided strip of semi-circular lobes designed to support the two butt welds above it (not shown).

The armor system remained intact although it was depressed and there were cracks in the second layer of armor along the welds on the lobes. The second layer of steel cracked only at the weld sites on the front and side joints. The cracks followed the welds and did not extend beyond the welds. Only the side of the center joint adjacent to the bomb cracked. However, as this was the most highly stressed area, the crack in the second layer followed the weld line for three lobes. No cracks ran into the plate.

The single sided and double sided lap joints formed with semi-circular lobes (welded only on the lobes and not the roots) were effective in keeping the roof armor in place when subjected to a steel pipe bomb filled with 454 g of smokeless powder.

Details of a composite material suitable for use in vehicle armoring are the subject of applicants co-pending U.S. patent application Ser. No. 09/172,477, filed October 15.

What is claimed is:

1. A system of joining first and second metal plates at an angle to one another comprising:

providing a connecting element with a first and second semi-circular rounded lobe, wherein the first and second lobes are disposed at an angle to one another corresponding to the angle of first and second metal plates to one another;

welding the first lobe of the connecting element to the first plate and the second lobe to the second plate near to an outside edge of the respective plate thereof to form a U-shaped welded region such that the ends thereof are directed to the outside edge of the plate such that a crack formed in the weld will tend to propagate along the weld to the outside of the plate; and welding a triangular gusset to the first and second lobes of the connecting element for reinforcement thereof.

2. The system of claim 1, wherein the connecting element comprises a plurality of semi-circular lobes.

3. The system of claim 2, wherein intermediate edge portions between adjacent lobes are curved whereby the edge of the plate defines a sine-wave shape.

4. The system of claim 1, wherein the triangular gusset extends short of the welded region of the lobe so as to maintain flexibility of the welded portion of the lobe.

* * * * *